US008482225B2

(12) United States Patent
Szczeszynski

(10) Patent No.: US 8,482,225 B2
(45) Date of Patent: Jul. 9, 2013

(54) ELECTRONIC CIRCUITS AND METHODS FOR DRIVING A DIODE LOAD

(75) Inventor: Gregory Szczeszynski, Hollis, NH (US)

(73) Assignee: Allegro Microsystems, LLC, Worcester, MA (US)

( * ) Notice: Subject to any disclaimer, the term of this patent is extended or adjusted under 35 U.S.C. 154(b) by 302 days.

(21) Appl. No.: 13/096,082

(22) Filed: Apr. 28, 2011

(65) Prior Publication Data

US 2012/0274228 A1 Nov. 1, 2012

(51) Int. Cl.
*H05B 37/02* (2006.01)

(52) U.S. Cl.
USPC ..... 315/307; 315/185 R; 315/209 R

(58) Field of Classification Search
USPC ..... 315/185 R, 186, 209 R, 291, 307–309
See application file for complete search history.

(56) References Cited

U.S. PATENT DOCUMENTS

| | | | | |
|---|---|---|---|---|
| 7,034,607 | B2 * | 4/2006 | Otake | 327/590 |
| 7,675,245 | B2 | 3/2010 | Szczeszynski et al. | |
| 8,421,364 | B2 * | 4/2013 | Archibald et al. | 315/209 R |
| 2004/0183380 | A1 * | 9/2004 | Otake | 307/82 |
| 2008/0106216 | A1 | 5/2008 | Yu et al. | |
| 2009/0128045 | A1 | 5/2009 | Szczeszynski et al. | |
| 2009/0289559 | A1 * | 11/2009 | Tanaka et al. | 315/185 R |
| 2009/0302776 | A1 | 12/2009 | Szczeszynski | |
| 2009/0322234 | A1 | 12/2009 | Chen et al. | |
| 2010/0072922 | A1 | 3/2010 | Szczeszynski et al. | |
| 2010/0164403 | A1 | 7/2010 | Liu | |
| 2010/0220049 | A1 * | 9/2010 | Murakami | 345/102 |
| 2010/0283322 | A1 | 11/2010 | Wibben | |
| 2011/0084734 | A1 * | 4/2011 | Russell et al. | 327/108 |
| 2011/0140621 | A1 | 6/2011 | Yi et al. | |

FOREIGN PATENT DOCUMENTS

CN 102 014 543 A 4/2011

OTHER PUBLICATIONS

"3A, 2 MHz Buck-Regulating LED Driver", A6210-DS, Rev. 1, 11 pages. Allegro MicroSystems, Inc., 115 Northeast Cutoff, Worcester, MA 01615. www.allergromicro.com.

Notification of International Search Report and Written Opinion of the International Searching Authority for PCT/US2012/031793, dated Jun. 20, 2012, 12 pages.

* cited by examiner

*Primary Examiner* — Don Le
(74) *Attorney, Agent, or Firm* — Daly, Crowley, Mofford & Durkee, LLP

(57) ABSTRACT

A circuit for driving an LED load with a controllable converter includes a control circuit configured to turn off the converter in response to a PWM signal having a first level and to turn on the converter in response to the PWM signal having a second level. A load disconnect switch coupled in series with the LED load is also controlled by the PWM signal so that the load disconnect switch is opened when the PWM signal turns off the converter to thereby open the load current path.

24 Claims, 5 Drawing Sheets

ELECTRONIC CIRCUITS AND METHODS FOR DRIVING A DIODE LOAD

FIELD OF THE INVENTION

This invention relates generally to electronic circuits and, more particularly, to electronic circuits used to drive a light emitting diode (LED) load.

BACKGROUND OF THE INVENTION

Electronic driver circuits for driving an LED load often include a controllable DC-DC converter for providing a controlled current to the load. When the load contains multiple parallel strings of LEDs, the driver circuit often requires complex current regulator circuits to generate identical currents through each LED string. Generating identical LED currents is complicated by the fact that the forward voltage of the LED strings can differ.

The need for complex current regulator circuits is eliminated in driver circuits that drive only a single LED string. In this case, the DC-DC converter can provide a controlled current to the LED string based on a simple feedback arrangement, such as sensing the voltage across a sense resistor coupled in series with the load.

An external signal, as may be referred to as a pulse width modulation (PWM) signal, may be used to control the brightness of the LEDs by turning on and off the DC-DC converter with a duty cycle proportional to the desired brightness. It is desirable for the PWM signal to quickly turn on and off the DC-DC converter in order to achieve the desired brightness, as is possible when the PWM signal controls the load current with a current regulator circuit. Thus, while the elimination of costly and complex current regulator circuits in a single string LED driver is desirable, the fast load current control that is useful for PWM brightness control and that can be achieved with the use of such current regulator circuits is also lost.

SUMMARY OF THE INVENTION

According to one aspect of the invention, an electronic circuit for driving an LED load with a controllable converter includes a control circuit having an input node configured to receive an error signal and an output node configured to provide a drive signal to the converter. The control circuit is responsive to a PWM signal to turn off the converter in response to the PWM signal having a first level and to turn on the converter in response to the PWM signal having a second level. A load disconnect switch coupled in series with the LED load has a control node responsive to the PWM signal and is configured to open in response to the PWM signal having the first level and to close in response to the PWM signal having the second level.

The circuit may further include a second switch coupled in series between the input node of the control circuit and a reference potential and having a control node responsive to the PWM signal so as to close in response to the PWM signal having the first level and to open in response to the PWM signal having the second level. Alternatively, the PWM signal may provide a digital enable/disable signal to the control circuit so as to disable the control circuit in response to the PWM signal having the first level. In one embodiment, the controllable converter is a DC-DC converter, such as a boost switching regulator. A sense resistor may be provided in series with the LED load and the error signal may be provided by an amplifier having a first input coupled to a reference potential and a second input coupled to the sense resistor. The load disconnect switch may be coupled between the LED load and a reference potential or between the converter and the LED load. A DC/PWM converter may be provided to convert a DC signal to the PWM signal.

According to another aspect of the invention, a method of controlling an LED load includes providing a drive signal to a converter that is configured to provide a regulated voltage to the LED load, the drive signal generated by a control circuit and causing the converter to turn off in response to a PWM signal having a first level and to turn on in response to the PWM signal having a second level. The method further includes generating an error signal indicative of a current flowing through the LED load for use by the control circuit to generate the drive signal and controlling a load disconnect switch that is coupled in series with the LED load with the PWM signal so as to open in response to the PWM signal having the first level and to close in response to the PWM signal having the second level.

According to another aspect of the invention, a method of controlling an LED load includes providing a regulated voltage to the LED load with a converter, periodically turning on and off the converter with a PWM signal, and opening a current path through the LED load when the converter is turned off.

With these arrangements, control of the LED brightness by the PWM signal occurs more quickly than otherwise possible. This is because the load disconnect switch opens the load current path when the converter turns off, thereby promptly terminating the load current flow (rather than waiting for the converter output capacitor to discharge). Opening the load current path in this manner also causes the load current to start flowing more quickly when the converter is next turned on since the converter output voltage is stored on the output capacitor when the load current path is opened (rather than waiting for the output capacitor to charge).

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Figure 1:
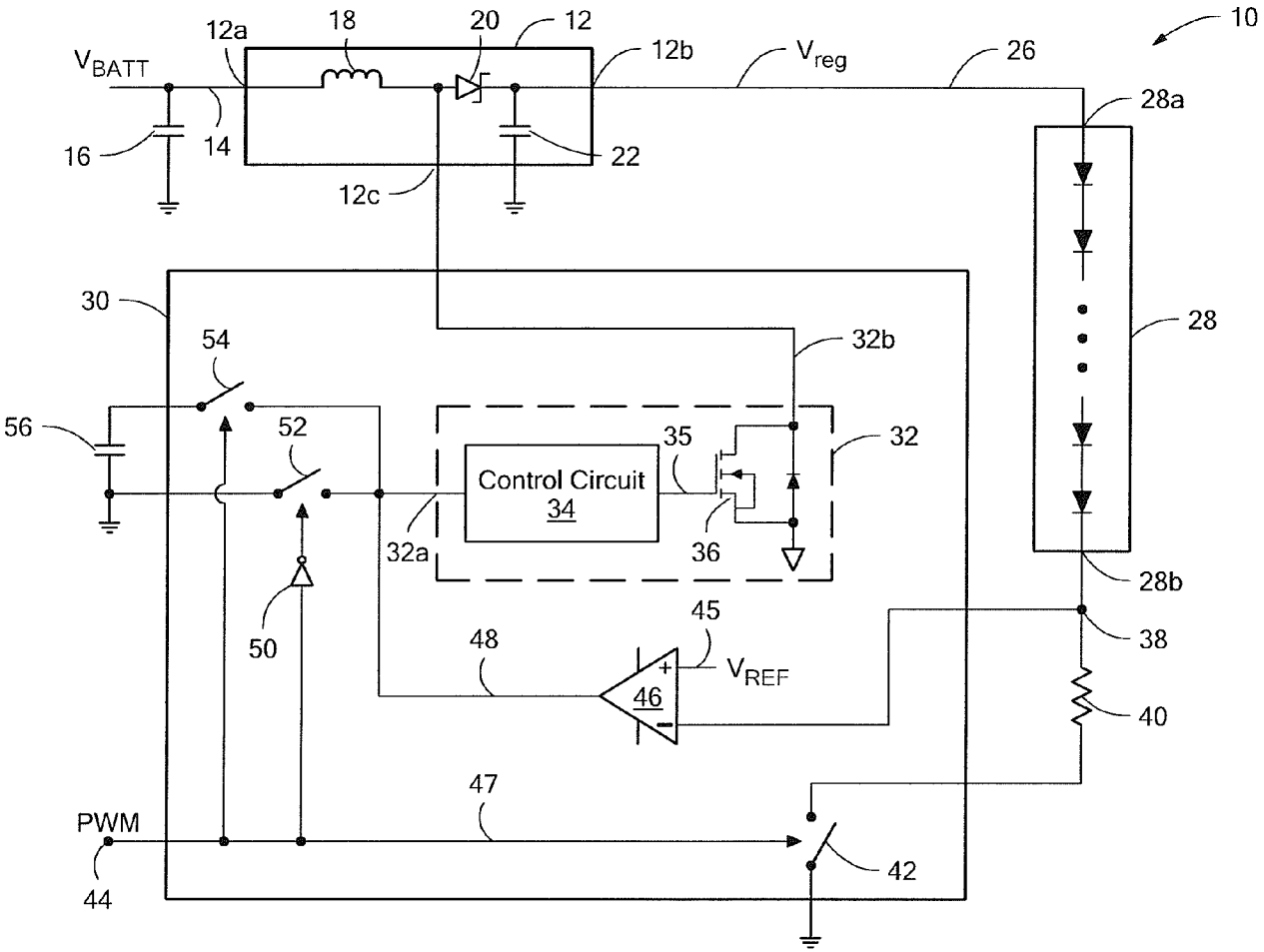
FIG. 1 is a schematic diagram of an electronic circuit for driving an LED load and including a load disconnect switch in series with the LED load.

Referring to FIG. 1, an electronic circuit 10 for driving an LED load 28 with a controllable voltage converter 12 is shown. The voltage converter 12 has an input node 12*a* at which an input voltage 14, $V_{BATT}$, is received, an output node 12*b* coupled to the LED load 28, and a control node 12*c*. In the illustrated embodiment, the controllable voltage converter 12 is a switching regulator and more particularly, is a boost switching regulator that provides a regulated output voltage 26, Vreg, at output node 12*b* that is greater than the input voltage 14. While a particular circuit topology of boost switching regulator is shown, it will be understood that a boost switching regulator can be formed in a variety of circuit configurations. It will be further understood that the controllable converter may take various conventional forms, such as a Buck converter, a Buck-boost converter, a charge pump, etc.

Figure 4:
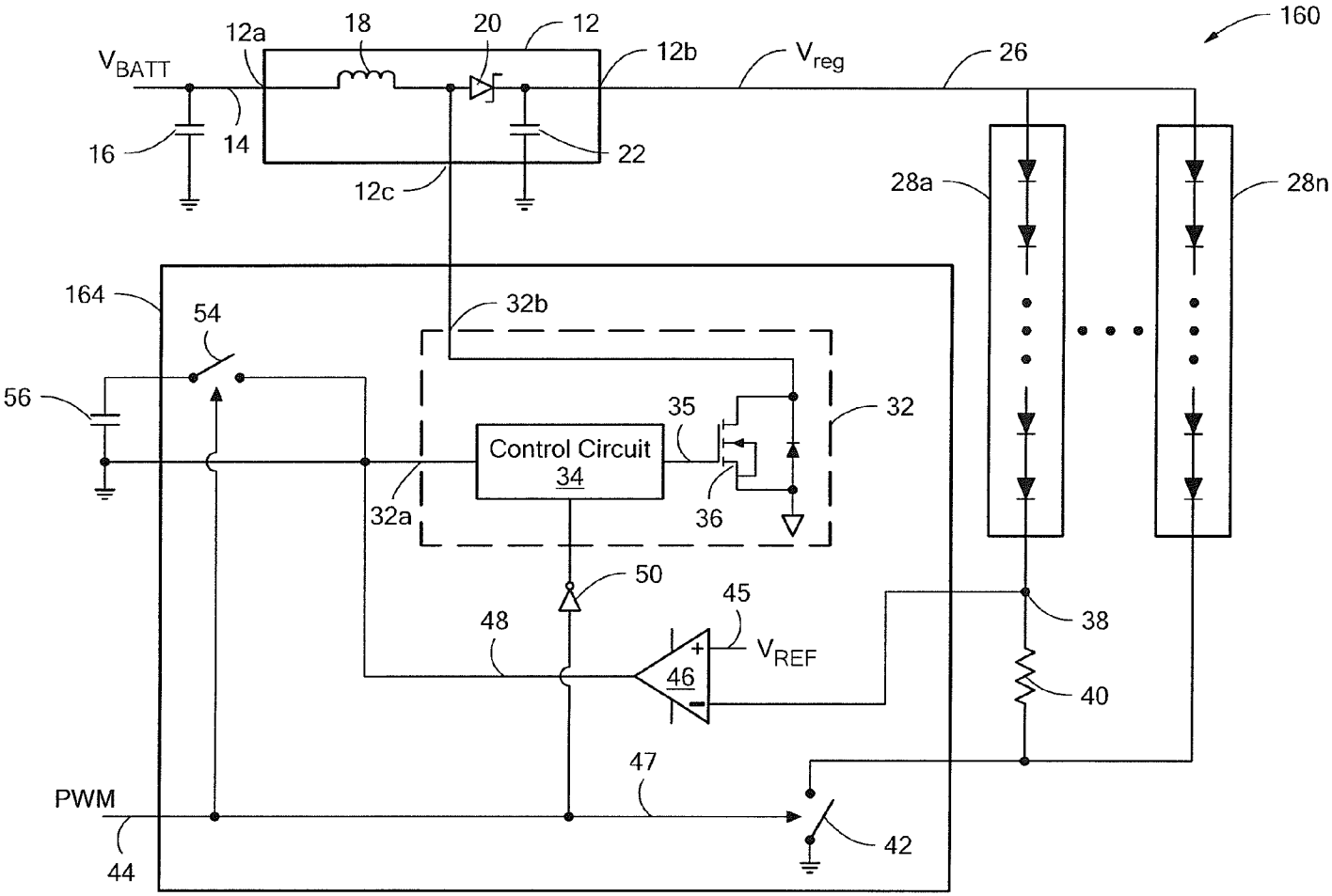
FIG. 4 is a schematic diagram of an electronic circuit for driving a multi-string LED load and illustrating an alternative arrangement for shutting off the converter.
Figure 4A:
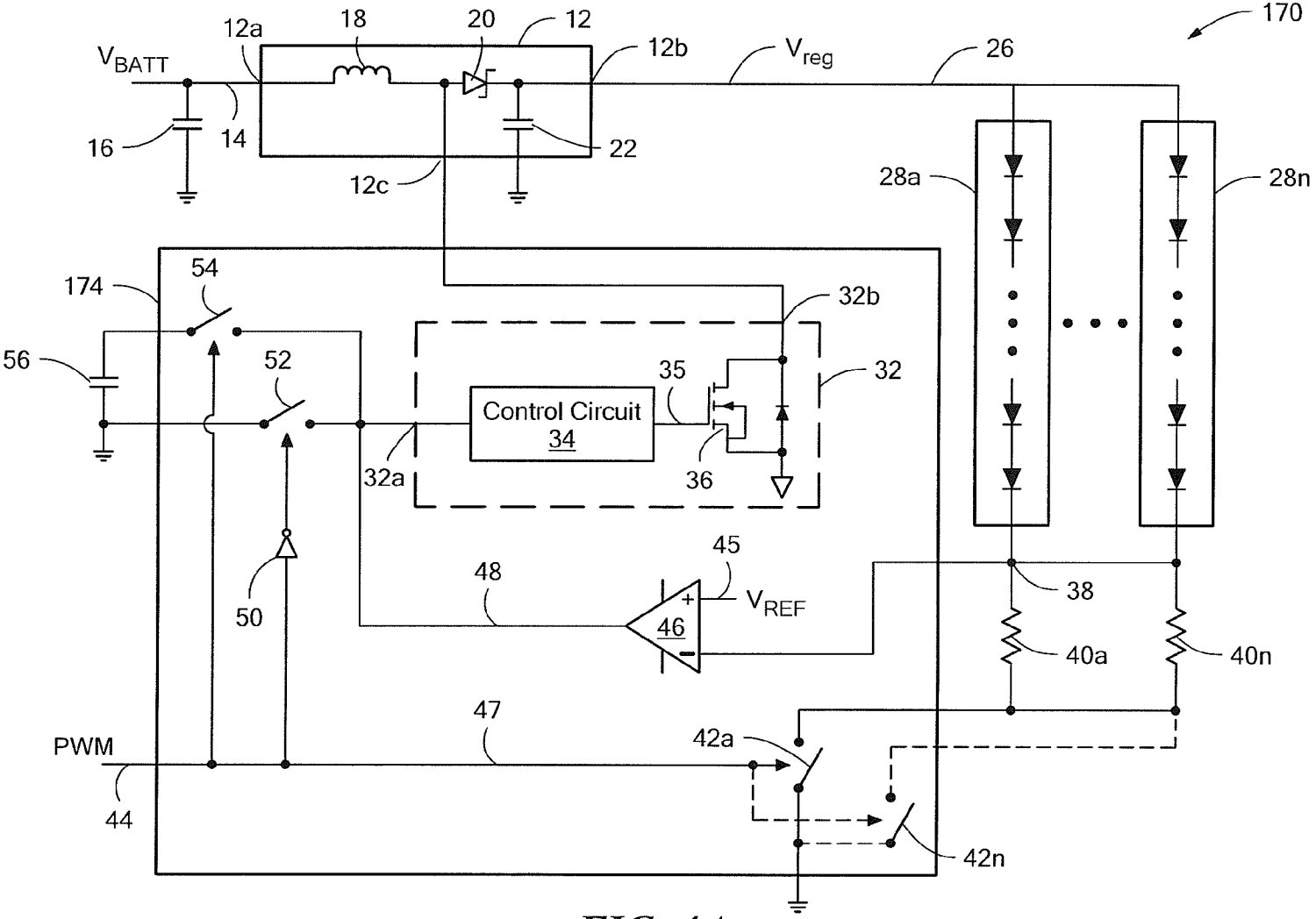
FIG. 4A is a schematic diagram of an alternative electronic circuit for driving a multi-string LED load.

The LED load 28 comprises a string of series connected LEDs, as may be used in an LED display. The LEDs are connected in series, cathode to anode, as shown. While the LED load 28 is shown in the form of a single LED string, it will be appreciated by those of ordinary skill in the art that the invention is applicable to driving multiple parallel LED strings, as shown in the embodiments of FIGS. 4 and 4A for example.

The electronic circuit 10 further includes an LED driver circuit 30 for controlling the voltage converter 12 so as to provide a predetermined level of drive current to the LED load 28 by providing a predetermined regulated output voltage, Vreg. The LED driver circuit 30 includes a switching circuit 32 having an input node 32*a* coupled to receive an error signal 48 and an output or switching node 32*b* coupled to the converter control node 12*c*.

The illustrative boost switching regulator 12 includes an inductor 18 having a first node coupled to the converter input node 12*a* and a second node coupled to an anode of a diode 20 and to the switching node 32*b*. An output capacitor 22 is coupled to a cathode of the diode 20 and the regulated output voltage 26, Vreg, is provided on the capacitor 22.

The boost switching regulator 12 can include, or is otherwise coupled to the switching circuit 32 such that the switching node 32*b* of the switching circuit 32 is coupled to the control node 12*c* of the converter. In some embodiments, an input capacitor 16 can be coupled to the input node 12*a* of the boost switching regulator 12.

The driver circuit 30 may be provided in the form of an integrated circuit. However, it will be appreciated by those of ordinary skill in the art that elements of the driver circuit 30 may be implemented discretely as desired to suit a particular application.

The switching circuit 32 includes a control circuit 34 and a switch 36. The control circuit 34 is responsive to the error signal 48 and provides a drive signal 35 to a switch 36 that controls the duty cycle of the switch conduction in accordance with the error signal level. The control circuit 34 may implement conventional pulse width modulation (PWM) control techniques. The regulated output voltage, Vreg, is maintained at the level necessary to achieve the predetermined drive current through the LED load 28 by way of a feedback loop described more fully below.

The driver circuit 30 also includes an error amplifier 46 configured to provide the error signal 48 and having a first input coupled to a node 38 of a sense resistor 40 to complete the feedback loop. The sense resistor 40 is coupled in series with the diode load 28 so that the voltage at node 38 is indicative of the current through the load. The error amplifier 46 has a second input responsive to a reference voltage 45, $V_{REF}$, such that the error signal 48 is indicative of the difference between the voltage at node 38 and the reference voltage, $V_{REF}$. The reference voltage $V_{REF}$ is selected to result in the predetermined drive current to the LED load.

The brightness of the LED load 28 is controlled by an external signal, here coupled to the driver circuit 30 at a PWM node 44 and referred to as a PWM signal 47. The PWM signal 47 is a digital signal that causes the converter 12 to turn on and off as necessary to achieve a desired LED brightness by adjusting the regulated voltage 26, Vreg. The PWM signal 47 is a relatively low frequency signal (e.g., in the range of hundreds of Hertz) as compared to the operating frequency of the switch circuit 32 and the voltage converter 12 (e.g., in the MegaHertz range). The PWM signal 47 is coupled to a switch 52 via an inverter 50, such that when the PWM signal is at a first signal level (referred to herein as being in an "off state"), the switch 52 is closed, thereby pulling the input node 32*a* of the switching circuit 32 and control circuit 34 to ground and turning off the switch 36 and switching regulator 12. Whereas, when the PWM signal 47 is at a second signal level (referred to herein as being in an "on state"), the switch 52 is open, thereby allowing the control circuit 34 and switch drive signal 35 to operate. Alternatively, as is illustrated in the embodiment of FIG. 4, the inverter 50 may be coupled directly to the control circuit 34 and the PWM signal 47 may provide a digital enable/disable signal to the control circuit 34.

According to the invention, the driver circuit 30 includes a further switch 42, referred to herein as a load disconnect switch, coupled in series with the LED load 28 and in the illustrated embodiment, between the sense resistor 40 and ground. The switch 42 is also controlled by the PWM signal 47. In particular, when the PWM signal 47 is at the first signal level, in the "off state," the switch 42 is open, thereby opening the load current path so that no current flows through the LED load 28. When the PWM signal 47 is at the second signal level, in the "on state," the switch 42 is closed and current can flow through the LED load. Thus, when the PWM signal 47 is in the off state, the current path through the LED load 28 is open so current quickly stops flowing through the load. Thus, the desired LED brightness is achieved by selectively turning on and off the voltage converter 12 and opening and closing the switch 42 with the PWM signal 47.

Interrupting the load current path occurs simultaneously with turning off the voltage converter 12. During the off state of the PWM signal, when the load current is zero, the regulated output voltage, Vreg, is held by the capacitor 22 so that when the PWM signal returns to the on state, the predetermined load current is provided to the LED load quickly, as is desirable.

The driver circuit 30 includes a further switch 54 coupled between the input 32*a* of the switching circuit 32 and a capacitor 56, as shown. Switch 54 is controlled by the PWM signal 47 such that the switch 54 is open during the PWM off state and is closed during the PWM on state so that the capacitor 56 is charged to the level of the error signal voltage 48 when the converter 12 is on and stores the error signal voltage when the converter is off. With this arrangement, when the PWM signal 47 next transitions to the on state to turn on the converter, the input node 32*a* of the switching circuit 32 is returned to the last error signal voltage level, thereby causing the regulated output voltage, Vreg, to achieve the desired predetermined voltage level more quickly than otherwise possible.

Figure 2:
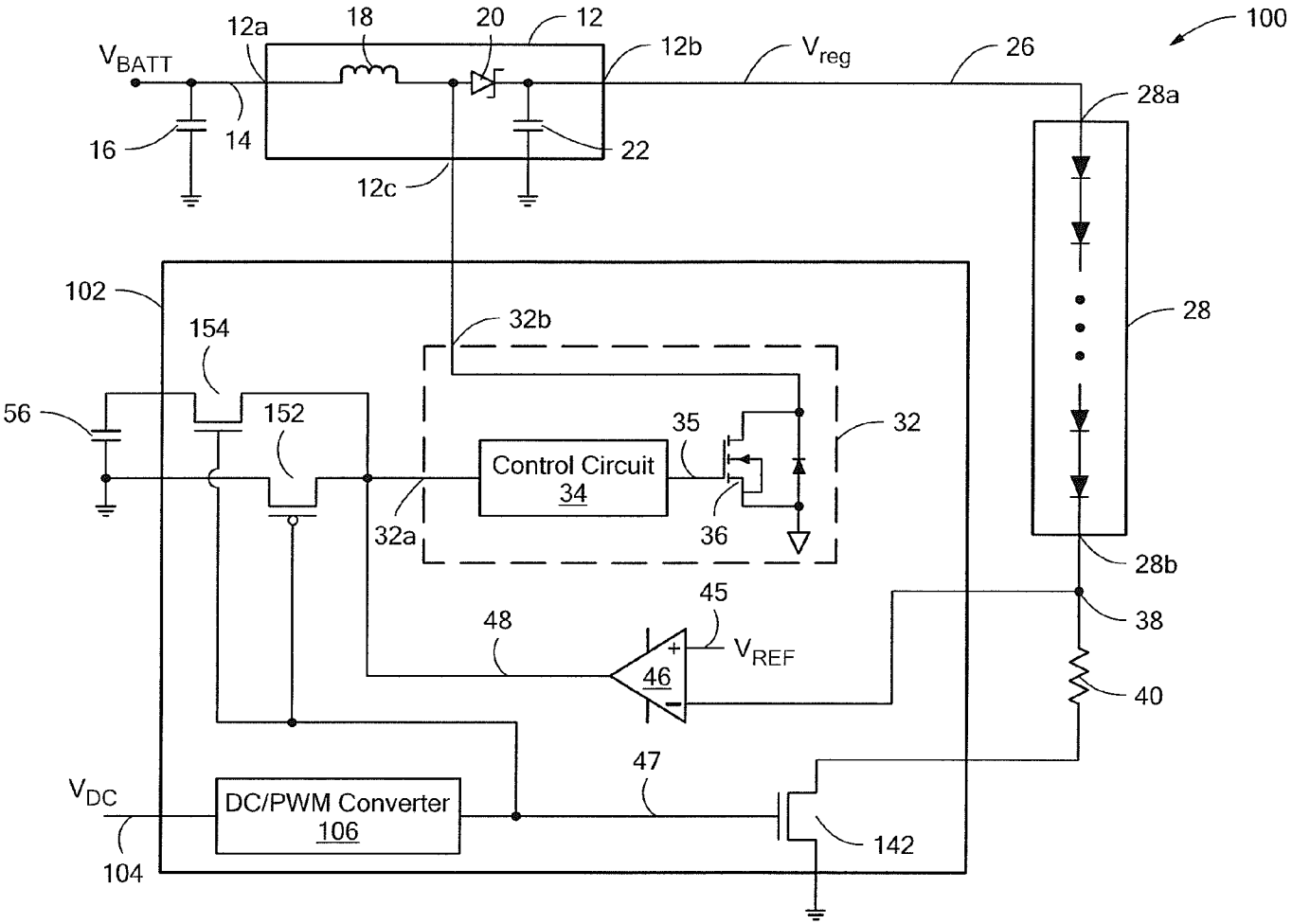
FIG. 2 is a schematic diagram of an alternative electronic circuit for driving an LED load in which the electronic circuit further includes a DC/PWM converter.

Referring to FIG. 2, in which like elements of FIG. 1 are shown having like reference designations, an alternative circuit 100 includes the DC-DC converter 12 and an alternative driver circuit 102. Driver circuit 102 includes a DC/PWM converter 106 to convert a DC input signal provided at a $V_{DC}$ node 104 into the PWM signal 47, which in turn controls switches 42, 52 and 54 in the manner described in connection with in FIG. 1.

More particularly, in this embodiment, the brightness of the LED load 28 is controlled by applying a DC voltage to the node 104 and the level of the DC voltage is converted by converter 106 into a PWM signal having a duty cycle proportional to the DC voltage level. For example, the DC/PWM conversion can be achieved by comparing the DC voltage level to a sawtooth waveform to provide the PWM signal 47.

Various alternative methods for controlling the brightness of the LED load 28 are also possible. For example, the driver circuit 102 can be configured to receive a serial pulse train input signal and convert this signal type to the digital PWM signal 47.

In the embodiment of FIG. 2, switches 42, 52 and 54 are shown to be MOSFETs. More particularly, switches 142 and 154 are shown as p-channel MOSFETs and the combination of switch 52 and inverter 50 (FIG. 1) is replaced with an n-channel MOSFET 152, as shown. It will be appreciated by those of ordinary skill in the art however that other switch types and arrangements are possible while still achieving the inventive advantages.

Figure 3:
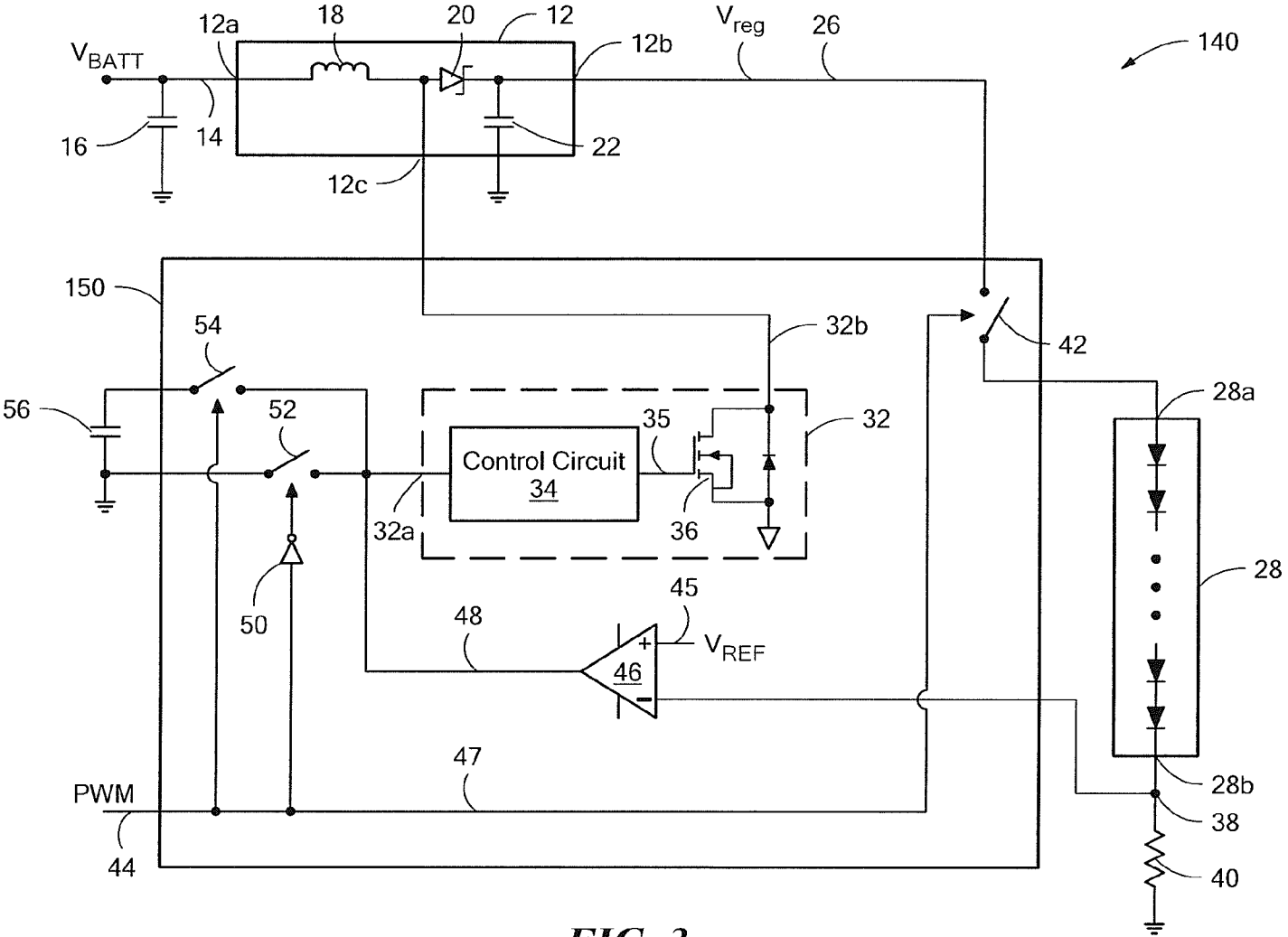
FIG. 3 is a schematic diagram of another alternative electronic circuit for driving an LED load including a load disconnect switch coupled between the DC-DC converter and the LED load.

Referring to FIG. 3, in which like elements of FIG. 1 are shown having like reference designations, an alternative circuit 140 includes the DC-DC converter 12 and an alternative driver circuit 150 that is configured such that the load disconnect switch 42 is coupled in series between the converter output node 12*b* and the anode of the LED load 28. The switch 144 is controlled in the same manner as switch 42 in FIG. 1, to open the current path through the LED load when the PWM signal 47 turns off the converter 12 and to close the current path through the LED load when the PWM signal turns on the converter.

While the embodiments of FIGS. 1-3 are shown to drive a single string LED load 28, it will be appreciated by those of ordinary skill in the art that the advantages of the load disconnect switch are applicable to driving multiple parallel LED strings, as shown in the embodiments of FIGS. 4 and 4A, in which like elements of FIG. 1 are shown having like reference designations.

Referring to FIG. 4, a circuit 160 includes the DC-DC converter 12 and an alternative driver circuit 164. Here, the LED load comprises a plurality of parallel coupled LED strings 28*a*-28*n*. In this multi-string embodiment, current regulators are not used to control the current through each LED string 28*a*-28*n*, but rather, the current is controlled based on feedback from a sensor resistor 40 coupled to a single string 28*a*. Since the forward voltage of the LED strings 28*a*-28*n* may vary, preferably, the string 28*a* coupled to the sense resistor 40 has the largest forward voltage drop in order to ensure that the regulated voltage is maintained at a level sufficient to accurately drive all of the LED strings but without requiring an excessively large sense resistor (and the concomitant power loss).

In the driver circuit 164, the switch 52 (FIG. 1) is omitted and the inverter 50 is coupled to the control circuit 34. In this embodiment, the PWM signal 47 provides a digital enable/disable signal to the control circuit 34. For example, the control circuit 34 may contain a logic gate, such as an AND gate, that is responsive to the switch drive signal and the PWM signal (or an inverted version of the PWM signal as shown) to generate the drive signal 35 according to a duty cycle established by the error signal 48, but in a manner that only allows the switch 36 to turn on when the PWM signal 47 is in the on state.

Referring also to FIG. 4A, an alternative circuit for driving multiple parallel LED strings 28*a*-28*n* includes the DC-DC converter 12 and an alternative driver circuit 174. Here again, rather than using current regulators to control the current through each LED string 28*a*-28*n*, the current is controlled based on feedback from a sense resistor. More particularly, here, each LED string 28*a*-28*n* is coupled to a respective sense resistor 40*a*-40*n*, which in turn is coupled to a load disconnect switch. The sense resistors 40*a*-40*n* may be separate discrete resistors or alternatively, may be implemented as a single resistor. Each sense resistor 40*a*-40*n* is coupled to the load disconnect switch 42*a*, as shown. Alternatively, and as shown by dotted lines, each sense resistor 40*a*-40*n* may be coupled to a respective load disconnect switch 42*a*-42*n*, which switches are under common control of the PWM signal 47. When the sense node 38 is coupled to multiple LED strings 28*a*-28*n*, as shown, the feedback signal is an average of the voltages at each string.

In view of the above, it will now be apparent that in a multi-string LED load embodiment, the current through multiple LED strings may be controlled by a feedback path from one (FIG. 4) or more (FIG. 4A) of the LED strings. Furthermore, each LED string may be coupled to a single load disconnect switch (FIG. 4) or to a separate, dedicated load disconnect switch (FIG. 4A). It will be further understood that even in a multi-string LED load embodiment in which the feedback path for regulation of the DC-DC converter is provided by a sense resistor coupled to only a single string 28*a* (FIG. 4), the other LED strings 28*b*-28*n* may be coupled to current regulator circuits for active regulation of the load current.

Having described preferred embodiments that serve to illustrate various concepts, structures and techniques that are the subject of this patent, it will now become apparent to those of ordinary skill in the art that other embodiments incorporating these concepts, structures and techniques may be used. Accordingly, it is submitted that that scope of the patent should not be limited to the described embodiments but rather should be limited only by the spirit and scope of the following claims.

What is claimed is:

1. An electronic circuit for driving an LED load with a controllable converter having an output node at which a regulated output voltage is provided, comprising:

a control circuit having an input node configured to receive an error signal and an output node configured to provide a drive signal to the converter, wherein the control circuit is responsive to a PWM signal to turn off the converter in response to the PWM signal having a first level and to turn on the converter in response to the PWM signal having a second level, and wherein the input node is further configured to receive a previous level of the error signal when the converter is turned on; and a load disconnect switch coupled in series with the LED load, having a control node responsive to the PWM signal, and configured to open in response to the PWM signal having the first level and to close in response to the PWM signal having the second level.

2. The electronic circuit of claim 1 further comprising a second switch coupled in series between the input node of the control circuit and a reference potential, having a control node responsive to the PWM signal, and configured to close in response to the PWM signal having the first level and to open in response to the PWM signal having a second level.

3. The electronic circuit of claim 1 wherein the converter is a DC-DC boost switching regulator.

4. The electronic circuit of claim 1 further comprising a sense resistor coupled in series with the LED load and an amplifier having a first input coupled to a reference potential, a second input coupled to the sense resistor, and an output at which the error signal is provided.

5. The electronic circuit of claim 1 wherein the load disconnect switch is coupled between the LED load and a reference potential.

6. The electronic circuit of claim 1 wherein the load disconnect switch is coupled between the output node of the converter and the LED load.

7. The electronic circuit of claim 1 wherein the LED load comprises a plurality of series coupled LEDs.

8. The electronic circuit of claim 1 further comprising a PWM signal generator for generating the PWM signal in response to a DC signal, the PWM signal generator configured to vary the duty cycle of the PWM signal in response to a level of the DC signal.

9. The electronic circuit of claim 1 wherein the load disconnect switch comprises a FET.

10. The electronic circuit of claim 1 further comprising an error signal switch coupled between the input node of the control circuit and a capacitor, having a control node responsive to the PWM signal, and configured to close in response to the PWM signal having the second level and open in response to the PWM having the first level.

11. A method of controlling an LED load comprising:

providing a drive signal to a converter, the converter configured to provide a regulated voltage to the LED load, the drive signal generated by a control circuit and causing the converter to turn off in response to a PWM signal having a first level and to turn on in response to the PWM signal having a second level;

generating an error signal indicative of a current flowing through the LED load for use by the control circuit to generate the drive signal;

providing a previous level of the error signal to the control circuit when the converter is turned on; and controlling a load disconnect switch with the PWM signal, the load disconnect switch coupled in series with the LED load and configured to open in response to the PWM signal having the first level and to close in response to the PWM signal having the second level.

12. The method of claim 11 wherein causing the converter to turn off in response to the PWM signal comprises controlling a second switch coupled in series with an input node of the control circuit and a reference potential with the PWM signal so that the second switch is closed in response to the PWM signal having the first level and is open in response to the PWM signal having the second level.

13. The method of claim 11 further comprising sensing a current through the LED load with a sense resistor, wherein generating the error signal comprises generating the error signal as an output of an amplifier having a first input coupled to a reference potential and a second input coupled to the sense resistor.

14. The method of claim 11 further comprising generating the PWM signal in response to a DC signal, wherein a duty cycle of the PWM signal varies in response to a level of the DC signal.

15. The method of claim 11 further comprising coupling the load disconnect switch between the LED load and a reference potential.

16. The method of claim 11 further comprising coupling the load disconnect switch between the output node of the converter and the LED load.

17. A method of controlling an LED load comprising:

providing a regulated voltage to the LED load with a converter controlled by a control circuit in response to an error signal;

periodically turning on and off the converter with a PWM signal;

providing a previous level of the error signal to the control circuit when the converter is turned on; and opening a current path through the LED load when the converter is turned off.

18. The method of claim 17 wherein opening the current path through the LED load comprises opening a load disconnect switch coupled in series with the LED load and controlling the load disconnect switch with the PWM signal.

19. The method of claim 18 wherein the load disconnect switch is coupled to an anode of the LED load.

20. The method of claim 18 wherein the load disconnect switch is coupled to a cathode of the LED load.

21. The method of claim 17 wherein providing a regulated voltage comprises:

sensing a current through the load;

generating an error signal in response to the sensed load current; and generating a drive signal for the converter with a control circuit in response to the error signal.

22. The method of claim 19 further comprising coupling an input node of the control circuit to a reference potential to turn off the converter and decoupling the input node of the control circuit from the reference potential to turn on the converter.

23. The method of claim 18 further comprising coupling the load disconnect switch between the LED load and a reference potential.

24. The method of claim 18 further comprising coupling the load disconnect switch between the output node of the converter and the LED load.

* * * * *